US010633792B2

(12) United States Patent
Quigley

(10) Patent No.: US 10,633,792 B2
(45) Date of Patent: Apr. 28, 2020

(54) PAPERMAKING FABRIC

(71) Applicant: VOITH PATENT GMBH, Heidenheim (DE)

(72) Inventor: Scott D. Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 112 days.

(21) Appl. No.: 15/550,484

(22) PCT Filed: Feb. 10, 2016

(86) PCT No.: PCT/EP2016/052797
§ 371 (c)(1),
(2) Date: Aug. 11, 2017

(87) PCT Pub. No.: WO2016/128445
PCT Pub. Date: Aug. 18, 2016

(65) Prior Publication Data

US 2018/0030653 A1 Feb. 1, 2018

Related U.S. Application Data

(60) Provisional application No. 62/114,762, filed on Feb. 11, 2015.

(51) Int. Cl.

| | |
|---|---|
| ***D21F 1/00*** | (2006.01) |
| ***D03D 13/00*** | (2006.01) |
| ***D21F 1/02*** | (2006.01) |
| ***D21F 3/02*** | (2006.01) |
| ***D21F 9/00*** | (2006.01) |
| ***D21F 11/00*** | (2006.01) |
| ***D21H 27/00*** | (2006.01) |
| ***D21H 27/02*** | (2006.01) |

(52) U.S. Cl.
CPC ..... *D21F 1/0045* (2013.01); *D03D 13/004* (2013.01); *D21F 1/02* (2013.01);
(Continued)

(58) Field of Classification Search
CPC .... D21F 1/0027; D21F 1/0036; D21F 1/0045; D21F 1/10; D21F 1/105; D21F 7/08;
(Continued)

(56) References Cited

U.S. PATENT DOCUMENTS 4,759,391 A * 7/1988 Waldvogel ..... D21F 1/0036 139/383 A
5,456,293 A 10/1995 Ostermayer et al.
(Continued)

FOREIGN PATENT DOCUMENTS

DE 19917869 A1 10/2000
EP 1885951 A1 2/2008
(Continued)

*Primary Examiner* — Eric Hug
(74) *Attorney, Agent, or Firm* — Laurence A. Greenberg; Werner H. Stemer; Ralph E. Locher

(57) ABSTRACT

A papermaking fabric for fibrous web forming or processing machines extends in MD and CD-directions and includes top and bottom fabric layers bound by binder yarns. The top layer is a web contacting side with top weave structures having interwoven first MD and first CD-yarns. The bottom layer is a machine contacting side with bottom weave structures having interwoven second MD and second CD-yarns. The top weave structure has repeats and forms fiber compression areas and fiber support areas recessed in thickness direction of the fabric relative to the fiber compression areas on the web side and fiber support areas separated by fiber compression areas or vice versa. A fiber compression area has adjacent top MD-floats on the web side or adjacent top CD-floats on the web side and a fiber support area has first MD and first CD-yarns interwoven in plain weave.

23 Claims, 6 Drawing Sheets

(52) U.S. Cl.
CPC ..... *D21F 3/0209* (2013.01); *D21F 9/00* (2013.01); *D21F 11/006* (2013.01); *D21H 27/002* (2013.01); *D21H 27/02* (2013.01)

(58) Field of Classification Search
CPC ..... D21F 7/083; D21F 7/12; D21F 11/006; D21F 11/14; D21F 11/145; D21H 27/002; D21H 27/02; D03D 3/04; D03D 11/00; D03D 13/004; D03D 25/00; D03D 25/005
USPC ..... 162/348, 358.2, 900, 902, 903, 116; 139/383 A, 425 A
See application file for complete search history.

(56) References Cited

U.S. PATENT DOCUMENTS

| | | | | |
|---|---|---|---|---|
| 5,520,225 | A | 5/1996 | Quigley et al. | |
| 6,039,838 | A | 3/2000 | Kaufman et al. | |
| 6,743,333 | B2 | 6/2004 | Lamb | |
| 7,743,795 | B2 * | 6/2010 | Quigley ..... | D21F 1/0045 139/383 A |
| 2007/0209770 | A1 | 9/2007 | Barrett et al. | |
| 2010/0206507 | A1 * | 8/2010 | Quigley ..... | D21F 1/0027 162/210 |
| 2012/0193052 | A1 | 8/2012 | Quigley | |

FOREIGN PATENT DOCUMENTS

| | | | |
|---|---|---|---|
| WO | 2006113818 | A1 | 10/2006 |
| WO | 2009030570 | A1 | 3/2009 |
| WO | 2013048992 | A1 | 4/2013 |

* cited by examiner

Weft Yarn Paths

Weave Pattern

| | | | | | | | | | | | | | | | | | | | | |
|---|---|---|---|---|---|---|---|---|---|---|---|---|---|---|---|---|---|---|---|---|
| | 2 | | 4 | 5 | | 7 | 8 | 9 | | 11 | 12 | | 14 | | | | | 19 | | B32 |
| 1 | 2 | | 4 | | | | | 9 | | | 12 | | 14 | | | | 17 | 18 | 19 | B31 |
| | | | | | | | | 9 | | | | | | | | | | | 19 | U30 |
| 1 | 2 | 3 | 4 | | 6 | 7 | 8 | 9 | 10 | 11 | 12 | 13 | 14 | | 16 | 17 | 18 | 19 | 20 | O29 |
| 1 | 2 | | 4 | | | 7 | | 9 | | | | | 14 | | | 17 | 18 | 19 | | B28 |
| | | | 4 | | | 7 | 8 | 9 | | 11 | 12 | | 14 | 15 | | 17 | | 19 | | B27 |
| | | | 4 | | | | | | | | | | 14 | | | | | | | U25 |
| | 2 | 3 | 4 | | 6 | 7 | | 9 | 10 | | 12 | 13 | 14 | | 16 | 17 | | 19 | 20 | O25 |
| 1 | 2 | | 4 | | | 7 | | | | | 12 | | 14 | 15 | | 17 | 18 | 19 | | B24 |
| | 2 | | 4 | | | 7 | 8 | 9 | | 11 | 12 | | 14 | | | 17 | | | | B23 |
| | | | | | | 7 | | | | | | | | | | 17 | | | | U22 |
| | 2 | 3 | 4 | | 6 | 7 | | 9 | 10 | | 12 | 13 | 14 | | 16 | 17 | | 19 | 20 | O21 |
| | 2 | | | | | 7 | | 9 | | 11 | 12 | | 14 | 15 | | 17 | 18 | 19 | | B20 |
| 1 | 2 | | 4 | | | 7 | 8 | 9 | | | 12 | | | | | 17 | | 19 | | B19 |
| | 2 | | | | | | | | | | 12 | | | | | | | | | U18 |
| | 2 | 3 | 4 | | 6 | 7 | | 9 | 10 | | 12 | 13 | 14 | | 16 | 17 | | 19 | 20 | O17 |
| | 2 | | 4 | | | 7 | 8 | 9 | | 11 | 12 | | 14 | | | | | 19 | | B16 |
| 1 | 2 | | 4 | | | | | 9 | | | 12 | | 14 | 15 | | 17 | 18 | 19 | | B15 |
| | | | | | | | | 9 | | | | | | | | | | 19 | | U14 |
| 1 | 2 | 3 | 4 | | 6 | 7 | 8 | 9 | 10 | 11 | 12 | 13 | 14 | | 16 | 17 | 18 | 19 | 20 | O13 |
| 1 | 2 | | 4 | 5 | | 7 | | 9 | | | | | 14 | | | 17 | 18 | 19 | | B12 |
| | | | 4 | | | 7 | 8 | 9 | | 11 | 12 | | 14 | | | 17 | | 19 | | B11 |
| | | | 4 | | | | | | | | | | 14 | | | | | | | U10 |
| | 2 | 3 | 4 | | 6 | 7 | | 9 | 10 | | 12 | 13 | 14 | | 16 | 17 | | 19 | 20 | O9 |
| 1 | 2 | | 4 | | | 7 | | | | | 12 | | 14 | | | 17 | 18 | 19 | | B8 |
| | 2 | | 4 | 5 | | 7 | 8 | 9 | | 11 | 12 | | 14 | | | 17 | | | | B7 |
| | | | | | | 7 | | | | | | | | | | 17 | | | | U6 |
| | 2 | 3 | 4 | | 6 | 7 | | 9 | 10 | | 12 | 13 | 14 | | 16 | 17 | | 19 | 20 | O5 |
| | 2 | | | | | 7 | | 9 | | 11 | 12 | | 14 | | | 17 | 18 | 19 | | B4 |
| 1 | 2 | | 4 | 5 | | 7 | 8 | 9 | | | 12 | | | | | 17 | | 19 | | B3 |
| | 2 | | | | | | | | | | 12 | | | | | | | | | U2 |
| | 2 | 3 | 4 | | 6 | 7 | | 9 | 10 | | 12 | 13 | 14 | | 16 | 17 | | 19 | 20 | O1 |
| 1 | 2 | 3 | 4 | 5 | 6 | 7 | 8 | 9 | 10 | 11 | 12 | 13 | 14 | 15 | 16 | 17 | 18 | 19 | 20 | |

FIG. 3

MS Weave Pattern

PAPERMAKING FABRIC

BACKGROUND OF THE INVENTION

Field of the Invention

The present invention relates to a papermaking fabric for use in the manufacturing of a fibrous web, like paper, board, tissue or non-woven webs. The present invention especially relates to a papermaking fabric used to produce structured tissue paper or non-woven webs for hygiene or wiping products.

A tissue paper is defined as a soft absorbent paper (softer than graphical or cardboard paper and having a higher tensile energy absorption index than graphical or cardboard paper; see DIN EN 12625-4 and DIN EN 12625-5) with a basis weight of between 8 to 40 g/m$^2$, preferably 10 to 25 g/m$^2$ per ply. A tissue paper can be mainly formed from natural fibers, such as cellulosic fibers.

The term non-woven web (ISO 9092, DIN EN 29092) applies to a wide range of products which, in terms of their properties, are located between those of paper (cf. DIN 6730, May 1996) and cardboard (DIN 6730) on the one hand and textiles on the other hand. A non-woven web can be mainly formed from natural fibers or synthetic fibers or a mixture thereof.

Especially tissue paper or non-woven webs for hygiene or wiping products need to have a structure providing bulky regions of lower density with good absorbency for liquids and less bulky regions of higher density with good tensile strength.

To manufacture such structured fibrous webs papermaking fabrics having a paper contacting side with elevated compression regions and valleys which separate the compression regions and which are recessed relative to the compression regions are used (also called structured fabrics) to impart to the tissue paper or non-woven web a structure having bulky regions with high absorbency and compressed regions with high tensile strength.

To manufacture such structured fibrous webs it is possible to form the web from a fibrous slurry on such a structured fabric or to impart the bulky and high tensile strength regions by molding or converting a already formed fibrous web on such a structured fabric.

DESCRIPTION OF THE RELATED ART

In the prior art single layered fabrics with a structured paper or web contacting side which forms pockets or ripples are known. In EP1885951, U.S. Pat. Nos. 5,520,225 and 5,456,293 for example single layer papermaking fabrics with a structured web or paper contacting side which forms pockets are disclosed. U.S. Pat. No. 6,039,838 shows a single layer, structured fabric with a plurality of ripples extending in machine direction and separated by valleys. The intended use of the above mentioned fabrics is the drying section, where the already formed paper sheet is further dried under the influence of heated dryer cylinders.

In the prior art in addition to the above mentioned fabrics, papermaker's fabrics are known with two independent fabric layers which are bound together by binder yarns. These so called SSB-fabrics are intended to be used as forming fabrics in the paper or web forming section of a papermaking machine. Onto these fabrics fibrous slurry is deposited and through these fabrics the initial dewatering of the fibrous slurry takes place to form the paper sheet. The forming fabrics known in the art have no structured paper contacting surface forming ripples or pockets.

In the past, the paper sheet usually is formed and initially dewatered on a flat forming fabric and afterwards imprinted on a structured fabric during the drying step.

It is also known in the art to deposit the fibrous slurry in the forming section between two fabrics, wherein the first one is a standard forming fabric through which the initial dewatering takes place and the other of the two fabrics is a single layer structured fabric which imparts a certain structure during the drying step of the paper sheet.

The single layer structured fabrics have some difficulties when used as forming fabrics through which dewatering takes place. This is because their single layer construction is too open and rough to provide good fiber retention. The reason is, that the yarns of these single layer fabrics have to provide both—the paper contacting side and the machine contacting side—and therefore need to have a bigger diameter and their distance needs to be bigger—all in comparison to the yarns providing the paper contacting side of known SSB-fabrics—to provide sufficient wear resistance and permeability. This is in contradiction to good fiber retention capabilities.

SUMMARY OF THE INVENTION

What therefore is needed is a papermaking fabric which is better suitable for use as a forming fabric to form structured paper sheets, more preferably a structured forming fabric with improved fiber retention combined with sufficient wear resistance. What further is needed is a method of forming a structured paper sheet which provides improved fiber retention.

The papermaking fabric according to the present invention is characterized in that the top weave structure is repeated in top weave repeats, wherein per top weave repeat the top weave structure forms one or more fiber compression area(s) and one or more fiber support area(s) recessed in thickness direction of the fabric relative to the fiber compression area(s) on the sheet contacting side. Further on fiber support areas are separated from each other by one or more fiber compression area and/or vice versa, wherein

- a fiber compression area being formed by one or more adjacent top MD-float(s) on the web contacting side or a fiber compression area being formed by one or more adjacent top CD-float(s) on the web contacting side and
- a fiber support area being formed by several of the first MD-yarns interwoven in a plain weave with several of the first CD-yarns.

For explanation:

A top MD-float is formed if a first MD-yarn passes on the web contacting side over at least two adjacent first CD-yarns.

A top CD-float is formed if a first CD-yarn passes on the web contacting side over at least two adjacent first MD-yarns.

It is possible that a fiber compression area is formed by one or more adjacent top MD-float(s). It is also possible that a fiber compression area is formed by one or more adjacent top CD-float(s). The fabric therefore can have fiber compression areas formed by top MD-float(s) and fiber compression areas formed by top CD-float(s).

Due to the feature that "fiber support areas are separate from each other by one or more fiber compression area and/or vice versa" it is possible that two fiber support areas are separated from each other by one or more fiber compression area(s). It is further possible that two fiber compression areas are separate from each other by a fiber support area.

The object is further solved with a method of making a structured paper sheet making use of the papermaking fabric according to the present invention, wherein the fibrous slurry is mainly, preferably fully dewatered through the structured papermaking fabric of the present invention.

With the papermaking fabric according to the present invention it is possible satisfy both requirements, namely to provides a structured sheet contacting side with compression areas and with fiber support areas which have, due to their plain weave structure, good fiber retention abilities, and to provide a machine contacting side with sufficient wear resistance.

Preferred embodiments of the present invention are further described in the dependent claims.

If the expressions "mainly" or "majority" are used it is meant that more than 50%, preferably at least 60%, most preferably at least 75% of the respective topic/property/technical feature is fulfilled.

If the expression "plain weave sequence" is used in connection with a single yarn it is meant, that this yarn weaves alternatingly over and under several adjacent yarns which mainly extend perpendicular to this yarn. If the expression "plain weave sequence" is used in connection with several yarns interweaving with other several yarns which extend perpendicular to the several yarns it is meant, that all these yarns together form a plain weave structure.

It has to be noted that the expression "consecutive top MD-floats" means top MD-floats immediately following each other in MD-direction and being formed by the same first MD-yarn or top MD-yarn. Consequently the expression "consecutive top CD-floats" means top CD-floats immediately following each other in CD-direction and being formed by the same first CD-yarn or top CD-yarn. The expression "adjacent top MD-floats" means top MD-floats immediately following each other in CD-direction and being formed by different first MD-yarns or top MD-yarns. Consequently the expression "adjacent top CD-floats" means top CD-floats immediately following each other in MD-direction and being formed by different first CD-yarns or top CD-yarns.

It is possible that the top weave structure forms pockets, wherein each pocket has a bottom part and an edge part at least partially, preferably fully surrounding the bottom part and wherein the fiber support area(s) provide the bottom parts of the pockets and the fiber compression area(s) provide the edge parts surrounding the bottom parts.

In this regard it is further possible that the edge part of at least some, preferably all of the pockets is formed by top MD-floats and by top CD-floats. The edge part of at least some of the pockets can further have a polygonal shape, especially a hexagonal or octagonal shape. Further it can be that at least some edge parts of the pockets, preferably all edge parts of the pockets together form a honey-comb like structure.

The pockets can have an aspect ratio of with their maximum extension in MD-direction to their maximum extension in CD-direction of between 0.25 to 4.

In concrete at least some, preferably all of the pockets can have a maximum extension of 0.5 to 2.5 millimeter in the MD-direction and a maximum extension of 0.5 to 2.5 millimeter in the CD-direction.

Further on, it can be that the majority, preferably each, of the bottom parts of the pockets is formed by at least two, preferably at least three adjacent first MD-yarns interwoven in a plain weave with at least two, preferably at least three adjacent first CD-yarns.

According to an alternate embodiment of the present invention it is also possible that the top weave structure forms ripples and valleys, which at least partially separate the ripples, wherein the fiber support area(s) provide the valleys and the fiber compression area(s) provide the ripples and wherein preferably each fiber compression area is formed by a plurality of adjacent top MD-floats which are grouped together, each of the top MD-floats being formed by a different first MD-yarn selected from a plurality of adjacent first MD-yarns.

In this regard it is further possible that at least some, preferably the majority, most preferably all of the grouped top MD-floats forming a respective compression area, are offset relative to each other in MD-direction. Further-on always two neighboring of the grouped top MD-floats may overlap each other in MD-direction.

To provide a paper sheet which has a visible and a stable structure with sufficient bulk, it is further advantageous if the fiber support area in average is recessed relative to the fiber compression area by 30 μm to 500 μm, preferably by 40 μm to 200 μm. A possible way to determine the height difference between a fiber compression area and a fiber support area it is possible to measure the maximum height of five single knuckles on the web contacting side of the regarded fiber support area and to calculate their average height. Further to measure the maximum height of five single floats on the web contacting side of the regarded fiber compression area and to calculate their average height. Then the average height of the regarded fiber compression area is subtracted from the average height of the regarded fiber support area.

According to a preferred embodiment at least some, preferably at least the majority of the first CD-yarns form top CD-floats on the web contacting side over at least three adjacent, preferably over at least four adjacent first MD-yarns. According to a further preferred embodiment at least some, preferably at least the majority of the first MD-yarns form top MD-floats on the web contacting side over at least three adjacent, preferably over at least four adjacent first CD-yarns.

Preferably most of the top MD-floats are longer than the top CD-floats.

According a further embodiment it is foreseen that some of the first CD-yarns are first CD-float-yarns. Each of these first CD-float-yarns form several top CD-floats which are consecutively arranged in CD-direction, wherein each of the top CD-floats is formed by passing of the respective first CD-float-yarn over a plurality of adjacent first MD-yarns. Preferably the first CD-float-yarns only form top CD-floats. Every two consecutive top CD-floats are preferably separated by a single first MD-yarn, which passes over the first CD-float-yarn between the two top CD-floats.

The consecutively arranged top CD-floats may follow a zigzag line.

Further it can be, that some of the first CD-yarns are first CD-plainweave-yarns, wherein each of the first CD-plainweave-yarns mainly, preferably only, form plain weave sequences.

Some of the first MD-yarns can be first MD-float-yarns, wherein each of the first MD-float-yarns forms several top MD-floats which are consecutively arranged in MD-direction and wherein each of the top MD-floats is formed by passing of the respective first MD-float-yarn over a plurality of adjacent first CD-yarns.

Further on, some of the first MD-yarns can be first MD-float-plainweave-yarns, which form top MD-floats and plain weave sequences which are alternatingly arranged in MD-direction. The alternating arrangement is such, that between two consecutive top MD-floats of a first MD-float-plainweave-yarn a plain weave sequence of this first MD-float-plainweave-yarn is located and vice versa.

According to a further concrete embodiment of the present invention it is foreseen, that the top MD-floats and/or the plain weave sequences of two first MD-float-plainweave-yarns, which are adjacently arranged in CD-direction are offset relative to each other in MD-direction. Offset in MD-direction of two adjacently arrange first MD-float-plainweave-yarns means, that while the one of the two adjacent first MD-float-plainweave-yarns forms a top MD-float by passing over a plurality of first CD-yarns the other of the two adjacent first MD-float-plainweave-yarns forms a plain weave sequence with the plurality of first CD-yarns and that while the other of the adjacent first MD-float-plainweave-yarns forms a top MD-float by passing over another plurality of first CD-yarns, the one of the two adjacent first MD-float-plainweave-yarns forms a plain weave sequence with the another plurality of first CD-yarns.

Some of the first MD-yarns can be first MD-plainweave-yarns which mainly, preferably only, form plain weave sequences, wherein preferably between two adjacent first MD-float-plainweave-yarns several first MD-plainweave-yarns are located.

According to another concrete embodiment of the present invention it is foreseen, that between two adjacent first CD-float-yarns several first CD-plainweave-yarns are located, wherein the first CD-plainweave-yarns form a plain weave sequence with at least some, preferably the majority, more preferably all of the adjacent first MD-yarns over which the first CD-float-yarns form top CD-float.

According to a further embodiment it is foreseen, that between two adjacent first MD-float-plainweave-yarns each of which forms a top MD-float over a plurality of common adjacent first CD-yarns, several adjacent first MD-plainweave-yarns are located, which form a plain weave sequence with at least some, preferably the majority, more preferably all of the common adjacent first CD-yarns.

In concrete it can be foreseen that the edge parts of the pockets can have a polygonal shape which can be formed by the first CD-float-yarns and first and second MD-float-plainweave-yarns when weaving first respectively second top MD-floats. It further can be foreseen that the plain weave sequences of the pockets are formed by the first CD-plainweave-yarns weaving plain weave sequence with the first MD-plainweave-yarns and with the first and second MD-float-plainweave-yarns.

According to a further preferred embodiment of the present invention it is foreseen, that the first CD-float-yarns provide groups of first CD-float-yarns (called CD-group), each CD-group being formed by three adjacent first CD-float-yarns, namely a first first CD-float-yarn, a second first CD-float-yarn and a third first CD-float-yarn.

It is further possible that the first MD-float-plainweave-yarns provide first and second groups of first MD-float-plainweave-yarns (called first and second MD-group), wherein the first MD-float-plainweave-yarns of the first MD-group form first top MD-floats and the first MD-float-plainweave-yarns of the second MD-group form second top MD-floats. According to this embodiment the first top MD-floats of different first MD-float-plainweave-yarns are in phase with each other, this means that the different first MD-float-plainweave-yarns all form plainweave sequences with the same first CD-yarns and first top MD-floats with the same first CD-yarns. Preferably the same applies for the second top MD-floats of different first MD-float-plainweave-yarns, which are all in phase with each other, what means that all the different first MD-float-plainweave-yarns form plainweave sequences with the same first CD-yarns and first MD-floats with the same first CD-yarns.

In addition each of the first top MD-floats passes over the first and the second first CD-float-yarn and all the first CD-yarns located between them and wherein the first MD-float-plainweave-yarns of the second MD-group form second top MD-floats, each of which pass over the second and the third first CD-float-yarns and all the first CD-yarns located between them. In addition it is preferably foreseen that the first top MD-floats pass over all the first CD-yarns which are located between the first first and the second first CD-float-yarn of a respective CD-group while the first MD-float-plainweave-yarns of the second MD-group weave a plain weave sequence with all the first CD-yarns which are located between the first first and the second first CD-float-yarn of the CD-group and that the second MD-floats pass over all the first CD-yarns which are located between the second first and the third first CD-float-yarn of the CD-group while the first MD-float-plainweave-yarns of the first MD-group weave a plain weave sequence with all the first CD-yarns which are located between the second first and the third first CD-float-yarn of the CD-group.

According to a concrete embodiment of the present invention it is possible that adjacent first MD-float-plainweave-yarns which form the first top MD-floats which have no offset relative to each other and that adjacent second MD-float-plainweave-yarns which form the second top MD-floats which have no offset relative to each other, but that the first top MD-floats have an offset relative to the second top MD-floats and that between two first top MD-floats which are adjacently arranged in CD-direction, a second top MD-float is located and vice versa.

Preferably all the first top MD-floats have the same length. Further on it is possible that all the second top MD-floats have the same length. Most preferably all the first and second top MD-floats have the same length.

According to a concrete embodiment of the present invention it can be that the first MD-yarns are provided by top MD-yarns and the first CD-yarns are provided by top CD-yarns and by the portions of the binder yarns which weave with the top MD-yarns. According to this embodiment the second MD-yarns are provided by bottom MD-yarns and the second CD-yarns are provided by bottom CD-yarns. In this case the top MD-yarns only weave with the top CD-yarns and with the binder yarns, wherein the top CD-yarns only weave with the top MD-yarns. Further the bottom MD-yarns only weave with the bottom CD-yarns and with the binder yarns, wherein the bottom CD-yarns only weave with the bottom MD-yarns. This means that the binder yarns weave with the top and the bottom MD-yarns. In this case the binder yarns extend in the CD-direction and the binder yarns contribute to the top weave structure but not to the bottom weave structure.

According to an embodiment different to the foregoing embodiment it is foreseen that the first MD-yarns are provided by top MD-yarns and by the portions of the binder yarns which weave with the top CD-yarns. The first CD-yarns are provided by top CD-yarns. In this case the second MD-yarns are provided by bottom MD-yarns and the second CD-yarns are provided by bottom CD-yarns, wherein the top MD-yarns only weave with the top CD-yarns, wherein the top CD-yarns only weave with the top MD-yarns and with the binder yarns. Further the bottom MD-yarns only weave with the bottom CD-yarns, wherein the bottom CD-yarns only weave with the bottom MD-yarns and with the binder yarns and wherein the binder yarns weave with the top and the bottom CD-yarns. In this case the binder yarns extend in the MD-direction and binder yarns contribute to the top weave structure but not to the bottom weave structure.

In more concrete the binder yarns can contribute to the plain weave sequences and preferably do not form a float, namely neither a top MD-float nor a top CD-float, on the web contacting side. Due to this preferred embodiment a secure connection between the two fabric layers allowing no or only few relative movements between the layers is achieved. This would not be the case if the binder yarns contributed to the top MD-floats or top CD-floats.

According to a further concrete embodiment of the present invention it is possible that the binder yarns are arranged in pairs of exchanging binder yarns, wherein each pair of exchanging binder yarns contributes to the top weave structure and binds together the two fabric layers such that, during the weave path of the two binders of the pair, the one of the binders weaves with top MD-yarns or top CD-yarns while the other of the binders weaves with at least one bottom MD-yarn or bottom CD-yarn, at a crossing point the two binders exchange such that after the crossing point the other of the binders weaves with top MD-yarns or top MD-yarns while the one of the binders weaves with at least one bottom MD-yarn or bottom CD-yarn. In this case the two binder yarns of each pair together form in the top fabric layer a weave path like a top MD-yarn, if the binders extend in the MD-direction, or like a top CD-yarn, if the binders extend in the CD-direction.

The fabric can have an air permeability of between 350 and 650 cfm.

Further on, the mesh count of the top fabric layer can be between 30 to 50 first MD-yarns per cm by 30 to 50 first CD-yarns per cm and/or the mesh count of the bottom fabric layer can be between 10 to 40 first MD-yarns per cm by 10 to 40 first CD-yarns per cm.

Preferably the diameter of the second MD-yarns is in the range of 0.2 mm to 0.9 mm. The diameter of the first MD-yarns can be between 30% to 60%, preferably between 38% to 53% of the diameter of the second MD-yarns.

To achieve a high fiber support it is further preferred that the ratio between first CD-yarns to second CD-yarns is greater than 1, preferably 2:1 or 3:2 or 4:3 or 5:3 and/or that the ratio between first MD-yarns to second MD-yarns is greater than one, preferably 2:1 or 3:2 or 4:3 or 5:3.

Further on it is possible that the diameter of the first CD-yarns is between 80% and 120% of the diameter of the first MD-yarns.

If the papermaking fabric is e.g. a so called "weft runner" it may be beneficial to increase the abrasion resistance by the feature that the diameter of the second CD-yarns is between 100% and 200% of the diameter of the second MD-yarns.

Preferably the second CD-yarns and/or the second MD-yarns can have a flattened cross section. Flattened cross section means that the cross section is not circular and has a width to height ratio greater than 1.

In the case that the cross section of the second CD-yarns and/or MD-yarns has a flattened cross section the expression "diameter" shall mean the diameter of a circular cross having the same surface area as the surface area of the flattened cross section.

According to a further embodiment the top surface layer may have a fiber support index (FSI) of around 250 to 350, as defined in the publication "Approved Standard Measuring Method" of the Papermachine Clothing Association (PCA), 19 Rue de la République, 45000 Orléans, France as of June 2004. By doing so, a sufficient fiber support can be achieved.

To provide on the other hand sufficient dewatering capability it is preferably foreseen that, preferably despite the high fiber support index defined above, the air permeability is sufficiently high. A good balance between high dewatering capability and good fiber support is achievable if the air permeability is in the range of between 250 cfm to 450 cfm, preferably 300 cfm tot 400 cfm, measured with a differential pressure of between 100 to 127 Pa as defined in publication "Approved Standard Measuring Method" of Papermachine Clothing Association (PCA), 19 Rue de la République, 45000 Orléans, France, of June 2004.

BRIEF DESCRIPTION OF THE SEVERAL VIEWS OF THE DRAWING

The invention is further described by way of a non-limiting example of a papermaker's fabric according to the present invention. It shows FIG. 1 a photograph onto the web contacting side over several repeat units of the papermaker's fabric, FIG. 2 the weave paths of the CD-yarns of a repeat unit of the papermaker's fabric from FIG. 1, FIG. 3 a repeat unit of the papermaking fabric from FIG. 1, FIG. 4 a repeat unit of the top fabric layer of the papermaker's fabric from FIG. 1 and FIG. 5 a repeat unit of the bottom fabric layer of the papermaker's fabric from FIG. 1.

DESCRIPTION OF THE INVENTION

Figure 1:
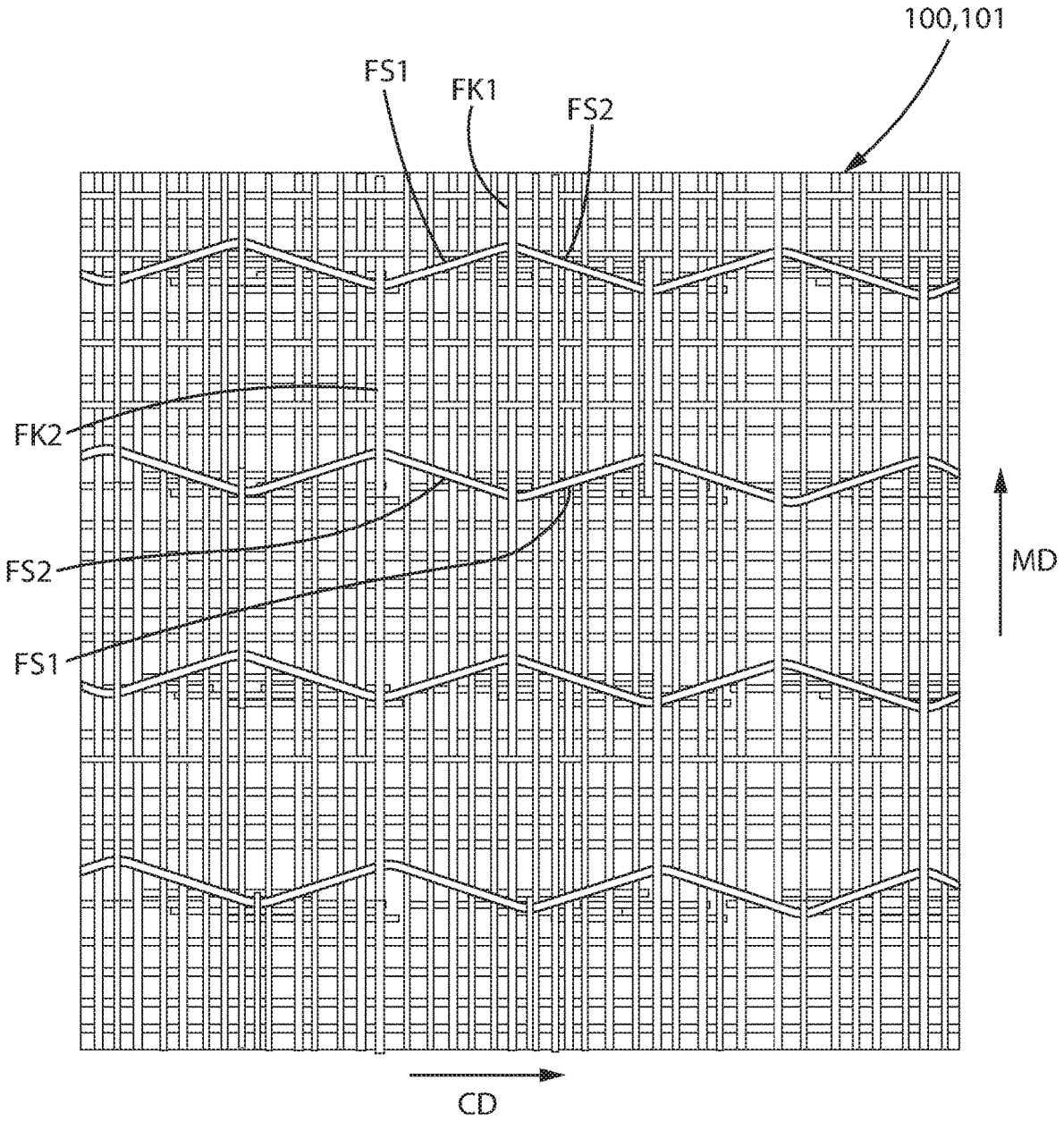
Figure 2:
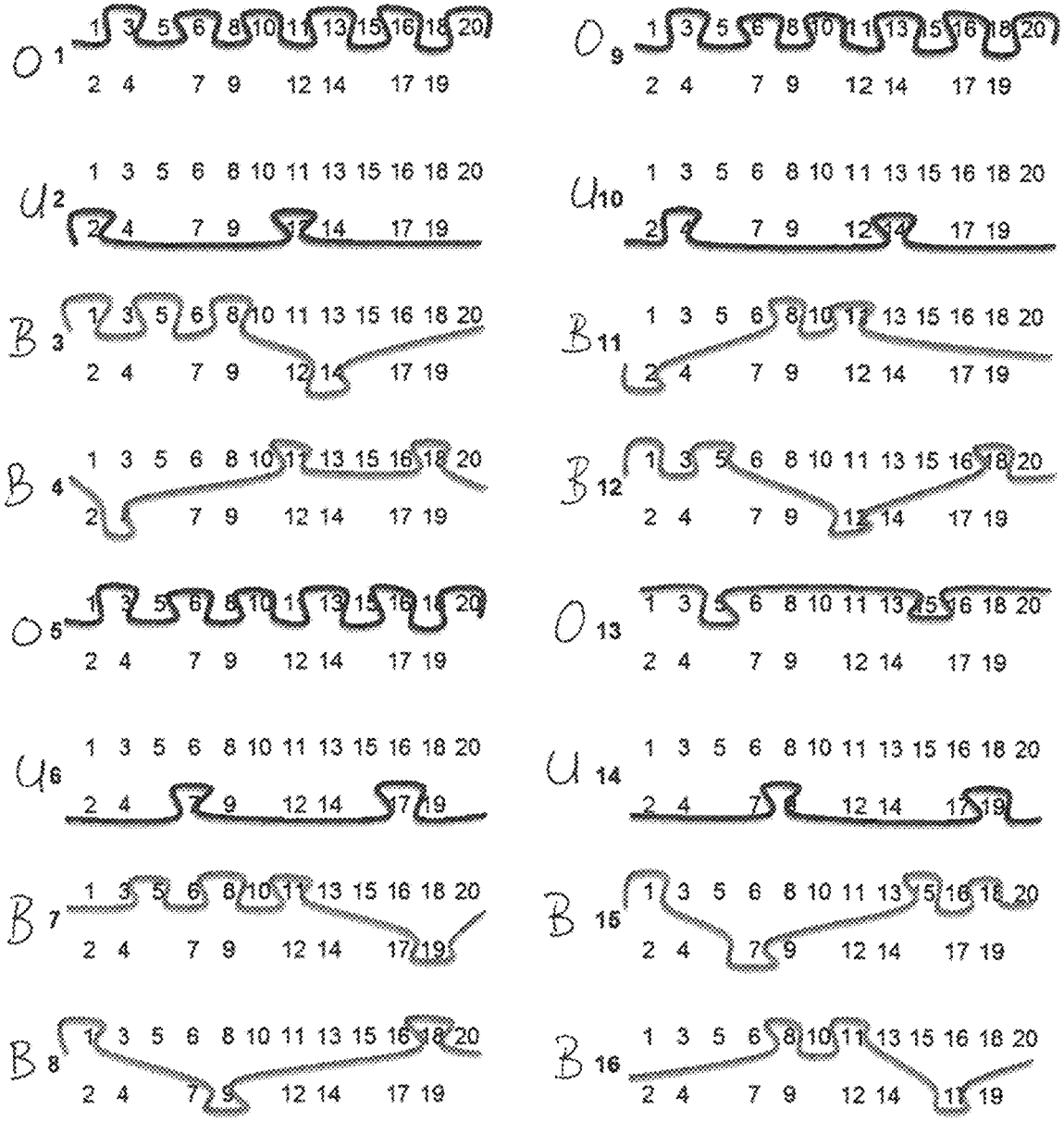
Figure 2:
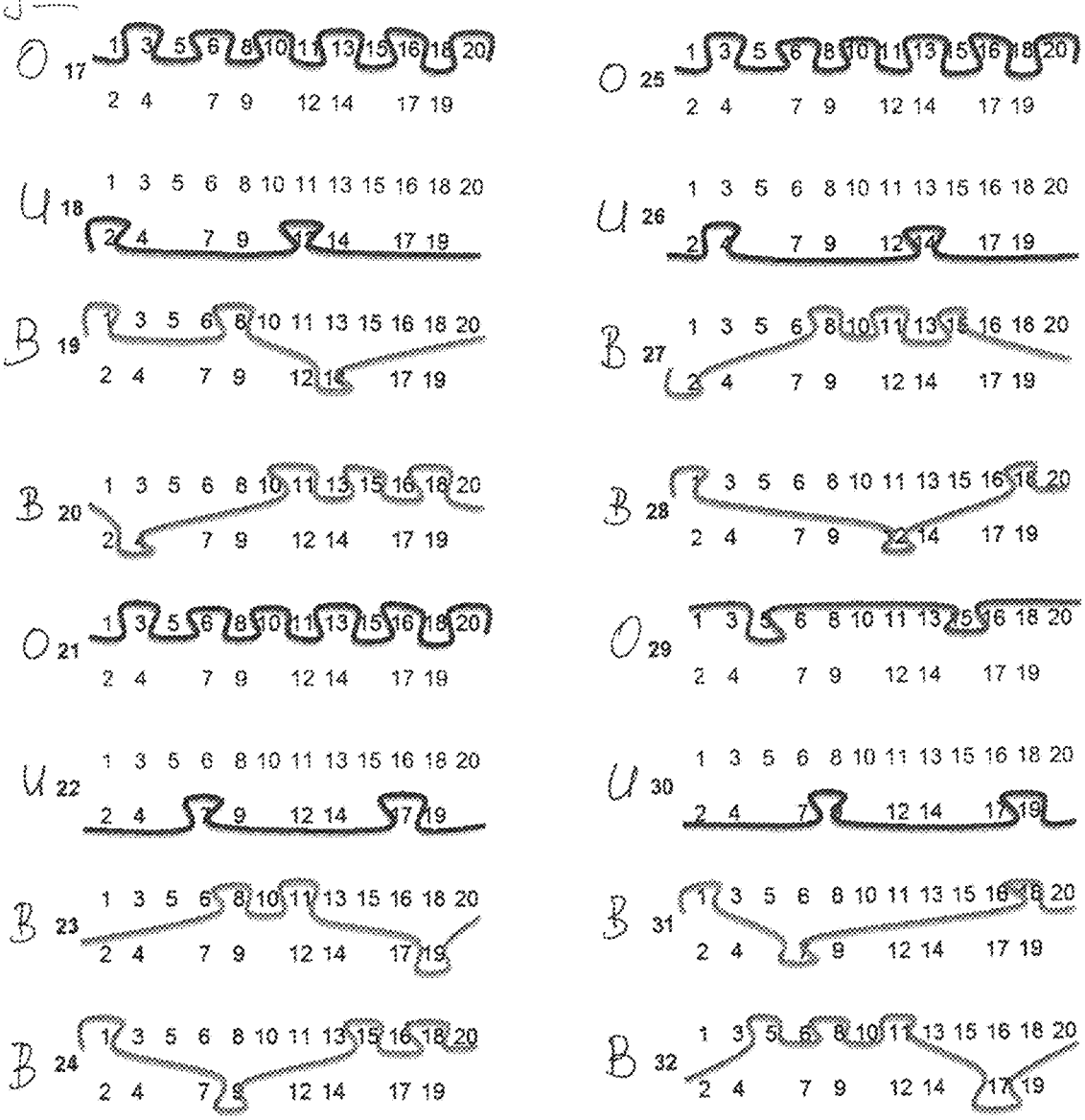

The papermaker's fabric 100 as can be seen in FIGS. 1 to 5 extends with its length in a MD-direction and with its width in a CD-direction and comprises a top fabric layer 101 and a bottom fabric layer 102.

The two fabric layers 101, 102 are bound together by binder yarns B3, B4, B7, B8, B11, B12, B15, B15, B19, B20, B23, B24, B27, B28, B31 and B32, in future in short cut named with "BS", when all binder yarns together are meant.

The top fabric layer 101 has a top weave structure providing a web contacting side. The top weave structure is formed by interweaving of first MD-yarns with first CD-yarns. In the current embodiment the first MD-yarns are provided by top MD-yarns 1, 3, 5, 6, 8, 10, 11, 13, 15, 16, 18, 20, in future written in short cut "OK", when all top MD-yarns together are meant. The first CD-yarns are provided by top CD-yarns O1, O5, O9, O13, O17, O21, O25, O29 and by the binder yarns "BS". The top CD-yarns O1, O5, O9, O13, O17, O21, O25, O29 are in future named with "OS", when all top CD-yarns together are meant. The binder yarns "BS" contribute to the top weave structure by continuing the weave structure formed by the top CD-yarns "OS" and the top MD-yarns "OK". The binder yarns further extend in the CD-direction.

As can be seen, the binder yarns "BS" are arranged in pairs of exchanging binder yarns B3/B4, B7/B8, B11/B12, B15/B16, B19/B20, B23/B24, B27/B28, B31/B32 wherein each pair of exchanging binder yarns contributes to the top weave structure and binds together the two fabric layers 101, 102 such that, during the weave path of the two binders of a pair, the one of the binders e.g. B3 weaves with top MD-yarns 1, 3, 5, 6, 8 while the other of the binders e.g. B4 weaves with a bottom MD-yarn 4, at a crossing point 10 the two binders B3/B4 exchange such that after the crossing point 10 the other of the binders B4 weaves with the top MD-yarns 11, 13, 15, 16, 18 while the one of the binders B3 weaves with a bottom MD-yarn 14. By doing so, the two binders of a binder pair B3/B4 together form a weave path in the top fabric layer like a top CD-yarn. The two binder yarns of a binder yarn pair are thus regarded as a first CD-yarn.

The bottom fabric layer 102 has a bottom weave structure providing a machine contacting side. The bottom weave structure is formed by interweaving of second MD-yarns with second CD-yarns. The second MD-yarns are provided by bottom MD-yarns 2, 4, 7, 9, 12, 14, 17, 19, in future written "UK", when all bottom MD-yarns together are meant. The second CD-yarns are provided by bottom CD-yarns U2, U6, U10, U14, U18, U22, U26, U30, which are in future named by "US", when all bottom CD-yarns together are meant. Based on that it is clear, that the binder yarns "BS" don't contribute to the bottom weave structure, because they do not continue the weave structure formed by the bottom CD-yarns "US" and the bottom MD-yarns "UK".

It has to be noted herein, that the top MD-yarns "OK" only weave with the top CD-yarns "OS" and with the binder yarns "BS", wherein the top CD-yarns "OS" only weave with the top MD-yarns "OK". It has to be further noted, that the bottom MD-yarns "UK" only weave with the bottom CD-yarns "US" and with the binder yarns "BS", wherein the bottom CD-yarns "US" only weave with the bottom MD-yarns "UK" and wherein the binder yarns "BS" weave with the top MD-yarns "OK" and with the bottom MD-yarns "UK".

The top weave structure is repeated in top weave repeats, wherein per top weave repeat the top weave structure forms several fiber compression areas and several fiber support areas P which are recessed in thickness direction of the fabric relative to the fiber compression areas on the web contacting side.

It has to be noted, that each of the fiber compression areas which mainly extends in CD-direction is formed by one of the top CD-floats FS1, FS2. For example a top CD-float FS1 is formed by the top CD-yarn O29 when passing on the web contacting side over the five adjacent top MD-yarns 6, 8, 10, 11, 13 or by the top CD-yarn O13 when passing on the web contacting side over the five adjacent top MD-yarns 1, 3, 16, 18, 20. As can be seen from FIG. 2, the binder yarns "BS" do not form top CD-floats on the web contacting side.

It has to be further noted, that each of the fiber compression areas which extend in MD-direction is formed by one of the top CD-floats FK1, FK2. For example a top MD-float FK1 is formed by the top MD-yarn 15 when passing on the web contacting side over the nine adjacent top CD-yarns and binder yarn pairs O29, B31/B32, O1, B3/B4, O5, B7/B8, O9, B11/B12, O13 wherein a top MD-float FK2 is formed by the top MD-yarn 5 when passing on the web contacting side over the nine adjacent top CD-yarns and binder yarn pairs O13, B15/B16, O17, B19/B20, O21, B23/B24, O25, B27/B28, O29. The top MD-yarns 5 and 15 are so called first MD-float-plainweave-yarns which form top MD-floats FK1 or FK2 and plain weave sequences which are alternatingly arranged in MD-direction such that between two consecutive top MD-floats FK1 or between two consecutive top MD-floats FK2 of a first MD-float-plainweave-yarn a plain weave sequence of the first MD-float-plainweave-yarn is located and vice versa. For example the first MD-float-plainweave-yarn 5 forms several consecutive top MD-floats FK2 and between two consecutive top MD-floats FK2 the first MD-float-plainweave-yarn 5 forms a plain weave sequence with the top CD-yarns O1, O5, O9, O13 and the binder yarn pairs B3/B4, B7/B8, B11/B12, B31/B32. Regarding first MD-float-plainweave-yarn 15 it's that this yarn forms several consecutive top MD-floats FK1 and between two consecutive top MD-floats FK1 the first MD-float-plainweave-yarn 15 forms a plain weave sequence with the top CD-yarns O13, O17, O21, O25 and the binder yarn pairs B15/B16, B19/B20, B23/B24, B27/B28.

Further on the top MD-floats FK1 and FK2 formed by the yarns 5 and 15 and the plain weave sequences of the two adjacent first MD-float-plainweave-yarns 5 and 15 are offset relative to each other in MD-direction in such a way that while the first of the two adjacent first MD-float-plainweave-yarns 5 forms a top MD-float FK2 by passing over a plurality of top CD-yarns O13, O17, O21, O25 and the binder yarn pairs B15/B16, B19/B20, B23/B24, B27/B28 the other of the two adjacent first MD-float-plainweave-yarns forms a plain weave sequence with the plurality of top CD-yarns O13, O17, O21, O25 and the binder yarn pairs B15/B16, B19/B20, B23/B24, B27/B28. Further on while the second of the two adjacent first MD-float-plainweave-yarns 15 forms a top MD-float FK1 by passing over a plurality of top CD-yarns O29, O1, O5, O9, O13 and the binder yarn pairs B3/B4, B7/B8, B11/B12, B31/B32 the other of the two adjacent first MD-float-plainweave-yarns forms a plain weave sequence with the plurality of top CD-yarns O29, O1, O5, O9, O13 and the binder yarn pairs B3/B4, B7/B8, B11/B12, B31/B32. The top MD-floats FK1 are herein called in the following first top MD-float FK1 and the top MD-floats FK2 are called in the following second top MD-float FK2.

As can be seen between the two adjacent 5 and 15 first MD-float-plainweave-yarns several first MD-plainweave-yarns 6, 8, 10, 11, 13 on the one side and 16, 18, 20, 1, 3 on the other side—when viewed in CD-direction—are located which mainly, preferably only, form plain weave sequences.

As can be seen, two adjacent fiber support areas P are separated from each other by the fiber compression areas formed by the top CD-floats FS1, FS2 and the first and second top MD-floats FK1, FK2. As can be seen, the first top MD-floats FK1 of different top MD-yarns 15 are in phase with each other. This means that the different first MD-float-plainweave-yarns 15 all form plainweave sequences with the same first CD-yarns and first MD-floats with other same first CD-yarns. The similar applies the second top MD-floats FK2 of different top MD-yarns 5, which are all in phase with each other, what means that the different first MD-float-plainweave-yarns 5 all form plainweave sequences with the same first CD-yarns and first MD-floats with other same first CD-yarns.

In the present embodiment of the invention all the first top MD-floats FK1 have the same length as well as all the second top MD-floats FK2 have the same length. In addition it can be seen, that all the first top MD-floats FK1 and second top MD-floats FK2 have the same length.

In addition each fiber support P area is formed by several top MD-yarns interwoven in a plain weave with several top CD-yarns. By way of example one of the fiber support areas P is formed by the top MD-yarns 6, 8, 10, 11, 13, 15, 16, 18, 20, 1, 3 interwoven in a plain weave with the top CD-yarns O17, O21, O25 and the binder yarn pairs B15/B16, B19/B20, B23/B24, B27/B28.

Figure 4:
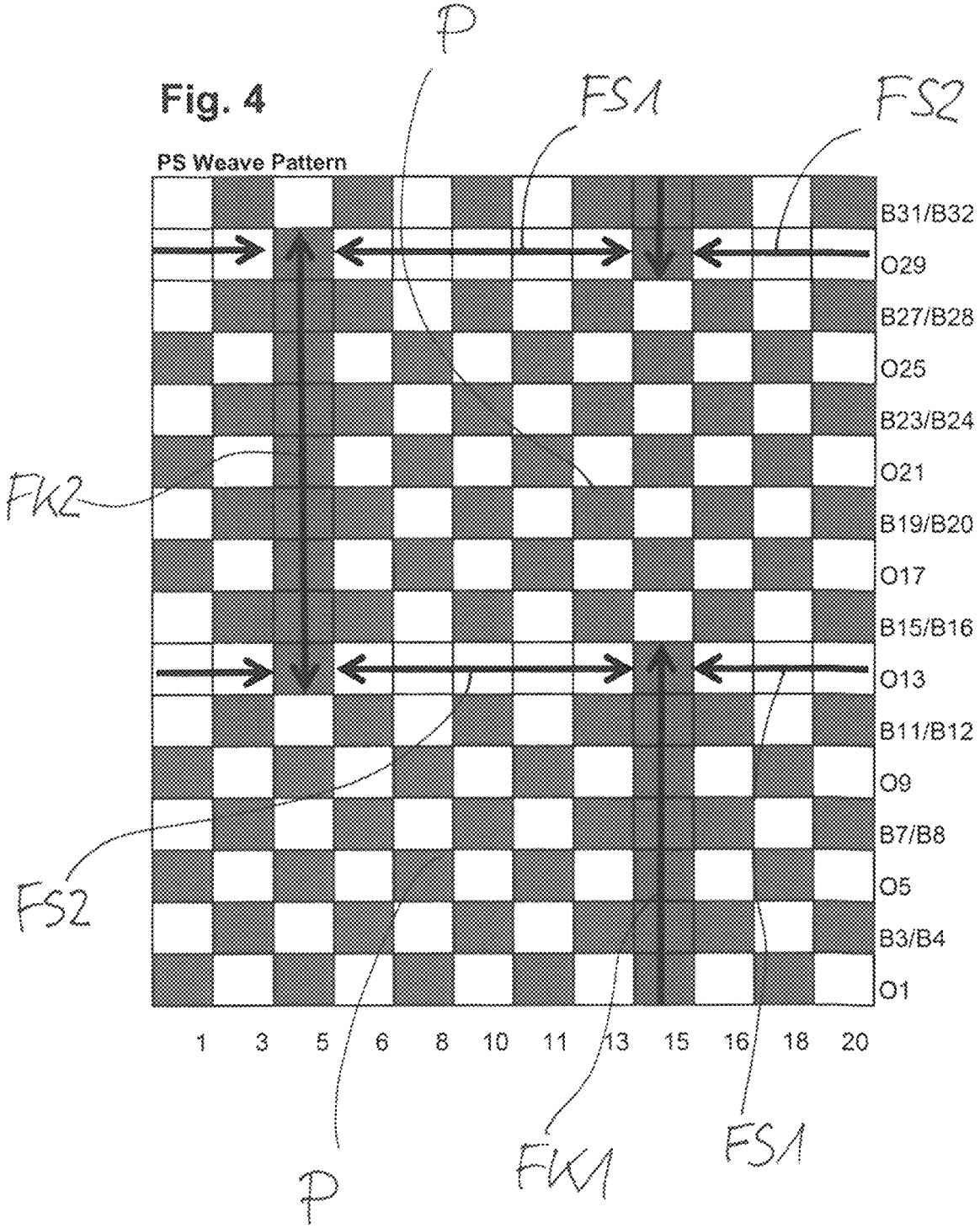
Figure 5:
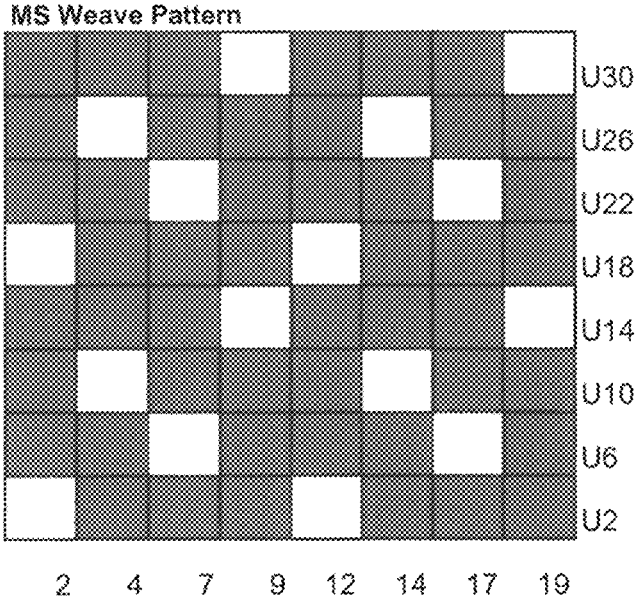

As can be especially seen from FIGS. 1 and 4, the top weave structure forms pockets, wherein each pocket has a bottom part and an edge part fully surrounding the bottom part. The bottom part of a pocket is provided by a fiber support area P and the edge part surrounding the bottom part of the pocket is provided by two adjacent first top MD-floats FK1 or by two second adjacent top MD-floats FK2 and by four top CD-floats FS1, FS2. It has to be noted, that always top CD-floats FS1, FS2 which are consecutively arranged in CD-direction are formed by the same top CD-yarn. By way of example some of the top CD-floats FS1 are formed by top CD-yarn O29 when passing over the adjacent top MD-yarns 6, 8, 10, 11 and 13 and the consecutive top CD-float FS2 is formed by the top CD-yarn O29 when passing over the adjacent top MD-yarns 16, 18, 20, 1 and 1. Further another of the top CD-floats FS2 is formed by top CD-yarn O13 when passing over the adjacent top MD-yarns 6, 8, 10, 11 and 13 and the consecutive top CD-float FS1 is formed by the top CD-yarn O13 when passing over the adjacent top MD-yarns 16, 18, 20, 1 and 1.

It has to be noted that the top CD-yarns O13, O29 are first CD-float-yarns, wherein each of the first CD-float-yarns O13, O29 forms several top CD-floats FS1, FS2 which are consecutively arranged in CD-direction, wherein each of the top CD-floats FS1, FS2 is formed by passing of the respective first CD-float-yarn O13, O29 over a plurality of adjacent top MD-yarns. As can be seen the consecutively arranged top CD-floats FS1, FS2 of the same top CD-yarn follow a zigzag line. This is achieved by the fact that all the top CD-floats indicated with FS1 extend from lower left to upper right, whereas all the top CD-floats indicated with FS2 extend from upper left to lower right—as can be seen from FIG. 1—and that between two consecutive top CD-floats FS1 of a top CD-yarn O13, O29 a top CD-float FS2 of this top CD-yarn O13, O29 is located and vice versa.

As can be seen between the two adjacent first CD-float-yarns O13, O29 several first CD-plainweave-yarns—provided by top CD-yarns O1, O5, O9, O17, O21, O25 and binder yarn pairs B3/B4, B7/B8, B11/B12, B15/B16, B19/B20, B23/BB24, B27/B28, B31/B32—are located, wherein the first CD—plainweave-yarns form a plain weave sequence with the majority of the adjacent top MD-yarns over which the first CD-float-yarns O13, O29 form top CD-floats FS1, FS2.

The six top CD- and MD-floats together are arranged such that the edge part of the pockets has a hexagonal shape and the edge parts of the pockets together form a honey-comb like structure.

The other of the first CD-yarns—which are either the binder yarn pairs B3/B4, B7/B8, B11/B12, B15/B16, B19/B20, B23/B24, B27/B28, B31/B32 or the top CD-yarns O1, O5, O9, O13, O17, O21, O25, O29 are so called first CD-plainweave-yarns. Each of these first CD-plainweave-yarns mainly, preferably only, form plain weave sequences when interweaving with the top MD-yarns "OK", wherein "mainly" in this case means that that more than 75% of the weave path the respective plainweave first CD-yarn forms a plain weave sequence.

In the embodiment shown in FIGS. 1 to 5, the fiber support area P in average is recessed relative to the fiber compression areas, which are formed by the top MD-floats FK1, FK2 and by the top CD-floats FS1, FS2, by 100 μm. The fabric 100 has an air permeability of between 350 and 650 cfm. The mesh count of the top fabric layer 101 can be between 30 to 50 first MD-yarns per cm by 30 to 50 first CD-yarns per cm and the mesh count of the bottom fabric layer 102 can be between 10 to 40 first MD-yarns per cm by 10 to 40 first CD-yarns per cm.

The invention claimed is:

1. A papermaking fabric extending in a MD-direction and in a CD-direction for a machine for at least one of forming or processing a fibrous web, the papermaking fabric comprising:

a top fabric layer, a bottom fabric layer and binder yarns binding said top and bottom fabric layers together;

said top fabric layer providing a web contacting side and having a top weave structure formed by interwoven first MD-yarns and first CD-yarns;

said bottom fabric layer providing a machine contacting side and having a bottom weave structure formed by interwoven second MD-yarns and second CD-yarns;

said top weave structure being repeated in top weave repeats, said top weave structure, per top weave repeat, forming one or more fiber compression area and one or more fiber support area recessed in a thickness direction of the fabric relative to said one or more fiber compression area on said web contacting side and fiber support areas being separated from each other by one or more fiber compression area or vice versa;

i. said one or more fiber compression area being formed by a top MD-float or at least two adjacent top MD-floats on said web contacting side or said fiber compression area being formed by a top CD-float or at least two adjacent top CD-floats on said web contacting side, wherein said top MD-float or each of said at least two adjacent top MD-floats is formed by one of the first MD yarns passing over at least two adjacent ones of the first CD yarns, and said top CD-float or each of said at least two adjacent top CD-floats is formed by one of the first CD yarns passing over at least two adjacent ones of the first MD yarns;

ii. said one or more fiber support area being formed by a plurality of said first MD-yarns interwoven in a plain weave with a plurality said first CD-yarns; and a honeycomb-shaped structure having an aspect ratio in a maximum extension in said MD-direction to a maximum extension in said CD-direction of between 0.25 and 4.

2. The papermaking fabric according to claim 1, wherein said top weave structure forms pockets, each of said pockets has a bottom part and an edge part partially or fully surrounding said bottom part, said one or more fiber support area provides the bottom parts of said pockets and said one or more fiber compression area provides said edge parts surrounding said bottom parts.

3. The papermaking fabric according to claim 2, wherein said edge part of at least some of said pockets is formed by said top MD-floats and by said top CD-floats.

4. The papermaking fabric according to claim 2, wherein a majority or each of said bottom parts is formed by two or at least three adjacent first MD-yarns interwoven in a plain weave sequence with at least two or at least three adjacent first CD-yarns.

5. The papermaking fabric according to claim 2, wherein at least some or all of said pockets have a maximum extension of 0.5 to 2.5 millimeters in said MD-direction and a maximum extension of 0.5 to 2.5 millimeters in said CD-direction.

6. The papermaking fabric according to claim 1, wherein said one or more fiber support area on average is recessed relative to said one or more fiber compression area by 30 μm to 500 μm or by 40 μm to 200 μm.

7. The papermaking fabric according to claim 1, wherein at least some of said first CD-yarns form top CD-floats on said web contacting side over at least three or at least four adjacent first MD-yarns and/or at least some of said first MD-yarns form top MD-floats on said web contacting side over at least three or at least four adjacent first CD-yarns.

8. The papermaking fabric according to claim 1, wherein some of said first CD-yarns are first CD-plainweave-yarns, and each of said first CD-plainweave-yarns mainly or only form plain weave sequences.

9. The papermaking fabric according to claim 8, wherein some of said first MD-yarns are first MD-float-plainweave-yarns forming top MD-floats and plain weave sequences being alternatingly disposed in said MD-direction, and a plain weave sequence of said first MD-float-plainweave-yarn is located between two consecutive top MD-floats of a first MD-float-plainweave-yarn and vice versa.

10. The papermaking fabric according to claim 9, wherein at least one of said top MD-floats or said plain weave sequences of adjacent first MD-float-plainweave-yarns are offset relative to each other in said MD-direction.

11. The papermaking fabric according to claim 9, wherein some of said first MD-yarns are first MD-plainweave-yarns mainly or only forming plain weave sequences, and a plurality of said first MD-plainweave-yarns are located between two adjacent first MD-float-plainweave-yarns.

12. The papermaking fabric according to claim 9, wherein a plurality of second first MD-yarns are disposed between adjacent first M D-float-plainweave-yarns.

13. The papermaking fabric according to claim 9, wherein at least some top MD-floats from different first MD-float-plainweave-yarns are offset relative to each other in said MD-direction.

14. The papermaking fabric according to claim 9, wherein a plurality of first MD-plainweave-yarns are located between two adjacent first MD-float-plainweave-yarns, and said first MD-plainweave-yarns form a plain weave sequence with at least some of said adjacent first CD-yarns over which one of said two first MD-float-plainweave-yarns form top MD-floats.

15. The papermaking fabric according to claim 9, wherein a plurality of adjacent first MD-plainweave-yarns are located between two adjacent first MD-float-plainweave-yarns forming top MD-floats over a plurality of common adjacent first CD-yarns forming a plain weave sequence with at least some or all common adjacent first CD-yarns.

16. The papermaking fabric according to claim 1, wherein:

said first MD-yarns are provided by top MD-yarns and said first CD-yarns are provided by top CD-yarns and by said binder yarns;

said second MD-yarns are provided by bottom MD-yarns and said second CD-yarns are provided by bottom CD-yarns;

said top MD-yarns only weave with said top CD-yarns and with said binder yarns;

said top CD-yarns only weave with said top MD-yarns;

said bottom MD-yarns only weave with said bottom CD-yarns and with said binder yarns;

said bottom CD-yarns only weave with said bottom MD-yarns; and said binder yarns weave with said top and said bottom MD-yarns.

17. The papermaking fabric according to claim 1, wherein:

said binder yarns are disposed in pairs of exchanging binder yarns;

each pair of exchanging binder yarns contributes to said weave structure and binds together said two fabric layers causing one of said binders to weave with said top MD-yarns or top CD-yarns and another of said binders to weave with at least one bottom MD-yarn or bottom CD-yarn during a weave path of said two binders of said pair; and said two binders are exchanged at a crossing point causing said other of said binders to weave with said top MD-yarns or top MD-yarns and one of said binders to weave with at least one bottom MD-yarn or bottom CD-yarn after said crossing point.

18. A papermaking fabric extending in a MD-direction and in a CD-direction for a machine for at least one of forming or processing a fibrous web, the papermaking fabric comprising:

a top fabric layer, a bottom fabric layer and binder yarns binding said top and bottom fabric layers together;

said top fabric layer providing a web contacting side and having a top weave structure formed by interwoven first MD-yarns and first CD-yarns;

said bottom fabric layer providing a machine contacting side and having a bottom weave structure formed by interwoven second MD-yarns and second CD-yarns;

said top weave structure being repeated in top weave repeats, said top weave structure, per top weave repeat, forming one or more fiber compression area and one or more fiber support area recessed in a thickness direction of the fabric relative to said one or more fiber compression area on said web contacting side and fiber support areas being separated from each other by one or more fiber compression area or vice versa;

i. said one or more fiber compression area being formed by a top MD-float or at least two adjacent top MD-floats on said web contacting side or said fiber compression area being formed by a top CD-float or at least two adjacent top CD-floats on said web contacting side, ii. said one or more fiber support area being formed by a plurality of said first MD-yarns interwoven in a plain weave with a plurality said first CD-yarns; and some of said first CD-yarns being first CD-float-yarns, each of said first CD-float-yarns forming a plurality of top CD-floats being consecutively disposed in said CD-direction, and each of said top CD-floats being formed by passing a respective first CD-float-yarn over a plurality of adjacent first MD-yarns.

19. The papermaking fabric according to claim 18, wherein said first CD-float-yarns only form top CD-floats.

20. The papermaking fabric according to claim 18, wherein a plurality of first CD-plainweave-yarns are located between two adjacent first CD-float-yarns, and said first CD-plainweave-yarns form a plain weave sequence with at least some or a majority of one or all of said adjacent first MD-yarns over which said first CD-float-yarns form top CD-floats.

21. The papermaking fabric according to claim 18, wherein:

some of said first MD-yarns are first MD-float-plainweave-yarns forming top MD-floats and plain weave sequences being alternatingly disposed in said MD-direction;

a plain weave sequence of said first MD-float-plainweave-yarn is located between two consecutive top MD-floats of a first MD-float-plainweave-yarn and vice versa;

said first CD-float-yarns provide groups of three adjacent first CD-float-yarns;

said first MD-float-plainweave-yarns provide at least a first and a second group of first MD-float-plainweave-yarns;

said first MD-float-plainweave-yarns of a first group form first top MD-floats, each passing over said first and said second first CD-float-yarn and all of said first CD-yarns located therebetween; and said first MD-float-plainweave-yarns of a second group form second top MD-floats, each passing over second and third first CD-float-yarns and all of said first CD-yarns located therebetween.

22. The papermaking fabric according to claim 21, wherein:

said first MD-floats pass over all of said first CD-yarns located between said first and said second first CD-float-yarn;

said first MD-float-plainweave-yarns of said second group weave a plain weave sequence with all of said first CD-yarns located between said first and said second first CD-float-yarn;

said second MD-floats pass over all of said first CD-yarns located between said second and said third first CD-float-yarn; and said first MD-float-plainweave-yarns of said first group weave a plain weave sequence with all of said first CD-yarns located between said second and said third first CD-float-yarn.

23. A papermaking fabric extending in a MD-direction and in a CD-direction for a machine for at least one of forming or processing a fibrous web, the papermaking fabric comprising:

a top fabric layer, a bottom fabric layer and binder yarns binding said top and bottom fabric layers together;

said top fabric layer providing a web contacting side and having a top weave structure formed by interwoven first MD-yarns and first CD-yarns;

said bottom fabric layer providing a machine contacting side and having a bottom weave structure formed by interwoven second MD-yarns and second CD-yarns;

said top weave structure being repeated in top weave repeats, said top weave structure, per top weave repeat, forming one or more fiber compression area and one or more fiber support area recessed in a thickness direction of the fabric relative to said one or more fiber compression area on said web contacting side and fiber support areas being separated from each other by one or more fiber compression area or vice versa;

i. said one or more fiber compression area being formed by a top MD-float or at least two adjacent top MD-floats on said web contacting side or said fiber compression area being formed by a top CD-float or at least two adjacent top CD-floats on said web contacting side, ii. said one or more fiber support area being formed by a plurality of said first MD-yarns interwoven in a plain weave with a plurality said first CD-yarns;

said top MD-float or at least two adjacent top MD-floats being said at least two adjacent top MD-floats and including first top MD-floats and second top MD-floats;

said first top MD-floats having no offset relative to each other and said second top MD-floats having no offset relative to each other;

said first top MD-floats having an offset relative to said second top MD-floats; and a second top MD-float being located between two first top MD-floats being adjacently disposed in said CD-direction, and vice versa.

* * * * *